US007282872B2

(12) United States Patent
Ohta et al.

(10) Patent No.: US 7,282,872 B2
(45) Date of Patent: Oct. 16, 2007

(54) DISCHARGE LAMP LIGHTING CIRCUIT

(75) Inventors: Shinji Ohta, Shizuoka (JP); Masayasu Ito, Shizuoka (JP)

(73) Assignee: Koito Manufacturing Co., Ltd., Minato-ku, Tokyo (JP)

( * ) Notice: Subject to any disclaimer, the term of this patent is extended or adjusted under 35 U.S.C. 154(b) by 415 days.

(21) Appl. No.: 10/916,753

(22) Filed: Aug. 12, 2004

(65) Prior Publication Data

US 2005/0062443 A1 Mar. 24, 2005

(30) Foreign Application Priority Data

Aug. 13, 2003 (JP) ..... P. 2003-292711

(51) Int. Cl.
*H05B 37/02* (2006.01)

(52) U.S. Cl. ..... 315/308; 315/291; 315/209 R

(58) Field of Classification Search ..... 315/291, 315/224, 307, 209 R, 225, 226, 308
See application file for complete search history.

(56) References Cited

U.S. PATENT DOCUMENTS 5,151,631 A 9/1992 Oda et al.
5,295,036 A 3/1994 Yagi et al.
5,491,387 A * 2/1996 Saito ..... 315/307
5,663,613 A 9/1997 Yamashita et al.
5,939,838 A * 8/1999 Janik ..... 315/277
5,952,791 A 9/1999 Watanabe et al.
6,437,515 B1 * 8/2002 Kamoi et al. ..... 315/209 R
2002/0117973 A1 8/2002 Ito et al.

FOREIGN PATENT DOCUMENTS

JP 10-312896 11/1998

* cited by examiner

*Primary Examiner*—Thuy V. Tran
*Assistant Examiner*—Dieu Hien T Duong
(74) *Attorney, Agent, or Firm*—Fish & Richardson P.C.

(57) ABSTRACT

In a discharge lamp lighting circuit 1, circuits 12, 13, which respectively detect a voltage applied to a discharge lamp 10 and a current flowing through the discharge lamp are provided. Light on/off state, furthermore, light on/off state detecting means 25 is provided, which detects light on state or light off state of the discharge lamp, in that the absolute value of the difference between voltage and current detection values of the discharge lamp in light off state is larger than that in light on state.

3 Claims, 5 Drawing Sheets

DISCHARGE LAMP LIGHTING CIRCUIT

This application claims foreign priority based on Japanese Patent application No. 2003-292711, filed Aug. 13, 2003, the contents of which is incorporated herein by reference in its entirety.

BACKGROUND OF THE INVENTION

1. Field of the Invention

The present disclosure relates to a technique for enhancing the reliability of a lighting circuit by determining the light on/off state of a discharge lamp robustly, using a detection signal of a voltage applied to the discharge lamp and that of a current flowing through the discharge lamp.

2. Description of the Related Art

A known discharge lamp lighting circuit employed in an automotive head lamp device or the like comprises a DC-DC converter, a DC-AC converter circuit, or a so-called inverter, and an activating circuit, or a so-called starter circuit. Such a lighting circuit further comprises a circuit for detecting a voltage applied to a discharge lamp and a current flowing through the discharge lamp (for example, see Japanese Patent Document JP-A-10-312896).

Detection values of the voltage and the current of the discharge lamp are used for controlling the power of the discharge lamp, and also, for example, it is used for a light on/off state determination, determining whether the discharge lamp is switched on or off.

For example, one method of detecting the current of the discharge lamp is to detect the current as a value, which is converted to a voltage, by providing a detection resistor, such as a shunt resistor, between the DC-DC converter and the DC-AC converter circuit. One method of detecting the voltage of the discharge lamp is to detect the voltage by voltage-dividing resistors, when the output voltage of the DC-DC converter is substantially equal to the voltage applied to the discharge lamp.

In conventional light on/off determination, it is possible to detect whether the discharge lamp is switched on or off, by using a voltage detection value or a current detection value of a discharge lamp. The voltage detection value or the current detection value is detected, and are compared to the threshold values respectively.

There addressed a problem in that, in the case where the conventional methods of a voltage or a current detection and a light on/off determination cannot be applied, correct determination is hardly conducted.

For example, in a configuration where a power is supplied to a discharge lamp without using a DC-DC converter, by simultaneously conducting a boost of a DC power supply input and conversion from a DC to an AC, the difference, which is the margin, between the detection values when the discharge lamp is switched on and off being small for the detection of the voltage or the current of the discharge lamp, it is difficult to ensure a sufficient detection accuracy. In other words, when the detection value in light-on state is close to that in light-off state, the detection values are hardly distinguished from each other, thereby causing a possibility of error in light on/off determination.

SUMMARY OF THE INVENTION

It is an object of the invention to enhance the reliability of a lighting circuit by determining the light on/off state of a discharge lamp robustly.

The discharge lamp lighting circuit of the invention comprises light on/off determining means for detecting a voltage applied to a discharge lamp, and a current flowing through the discharge lamp, and for determining a light on state or a light off state of the discharge lamp, with respect to an absolute value of a difference between a voltage detection value and a current detection value of the discharge lamp, considering the value in light off state of the discharge lamp is larger than the value in light on state of the discharge lamp.

In the above configuration, the following means maybe further provided:

- a circuit which subtracts the current detection value from the voltage detection value, and a circuit which compares a result of the subtraction with the threshold voltage; and
- a DC-AC converter circuit which receives a DC input, and which conducts AC conversion and a boosting operation, comprising an AC conversion transformer, plural switching elements, and a resonance capacitor, the DC-AC converter circuit controls a driving frequency of the switching elements, and supplies a resonance voltage from the AC conversion transformer to the discharge lamp, the resonance voltage depends on an inductance components of the resonance capacitor and the AC conversion transformer or an inductance element connected to the resonance capacitor.

According to the invention, therefore, both the voltage and current detection values of the discharge lamp are used, and the light on and off states can be correctly detected based on the absolute value of the difference between the detection values.

DESCRIPTION OF THE PREFERRED EMBODIMENTS

It is an object of the invention to realize determination of light on/off state of a discharge lamp which is hardly affected by variation of the input voltage or the tube voltage of the discharge lamp, and prevent disadvantages such as an increase in cost.

The invention can be applied, for example, to a mode where a DC-DC converter and an inverter, such as a DC-DC converter circuit, are used, and also can be applied to a mode which is functioning as DC-AC converter and a boost circuit, including boost of the starting signal, where the latter mode is suitable for a higher frequency. Hereinafter, the latter mode, which does not have a DC-DC converter, will be described below.

Figure 1:
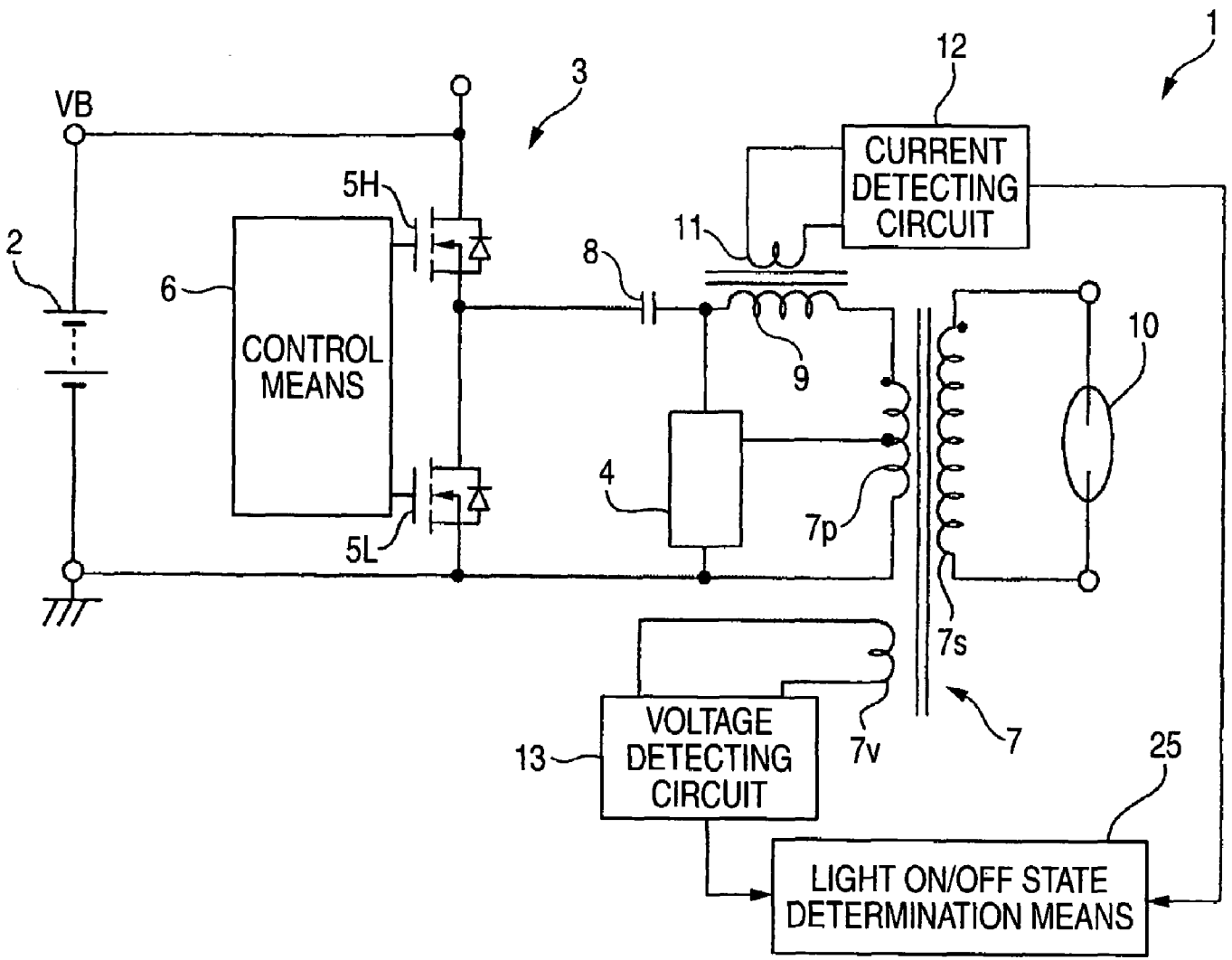
FIG. 1 is a diagram showing an example of the basic configuration of the invention.

FIG. 1 shows an example of the basic configuration of the invention. A discharge lamp lighting circuit 1 comprises a DC-AC converter circuit 3 which receives a power supply from a DC power source 2, and a starting circuit 4.

The DC-AC converter circuit 3 is provided to receive a DC input voltage, denoted as "VB", from a battery or the like, and conduct conversion to AC and a boosting operation. In this example, the DC-AC converter circuit is of the half-bridge type, and comprises two switching elements 5H, 5L, and controlling means 6 for activating the switching elements to control a switching operation. Specifically, one end of the switching element 5H on the higher side is connected to a power supply terminal, the other end of the switching element is grounded through the switching element 5L on the lower side. The elements 5H, 5L are respectively turned ON/OFF by the controlling means 6. In this example, field-effect transistors (FETs) are used as the elements 5H, 5L. Alternatively, other semiconductor switching elements such as bipolar transistors may be adequately used. In the case where FETs are used as in this example, the ON/OFF state of each of the FETs is defined in accordance with the driving voltage supplied to the gate of the FET from the controlling means 6. As each FET itself has a parasitic diode, when both the FETs are in the OFF state, therefore, a current flows through the parasitic diodes. In the case where bipolar transistors are used, a signal is supplied to each base from the controlling means 6 so that their ON/OFF states are defined. When a diode is connected in parallel to each of the transistors, the current flows through the diodes when both the transistors are in the OFF state.

The DC-AC converter circuit 3 comprises an AC conversion transformer 7, and has structure in which primary and secondary circuits are electrically insulated from each other. In this example, a circuit configuration is used which is based on a resonance phenomenon between a resonance capacitor 8 and an inductor or an inductance component. The following two kinds of modes may be employed:

(I) a mode which uses a resonance phenomenon between the resonance capacitor 8, and the inductances of an inductance element 9 and the primary winding 7*p* of the AC conversion transformer 7; and (II) a mode which uses a resonance phenomenon between the resonance capacitor 8, and the leakage inductances of the inductance element 9 and the AC conversion transformer 7.

In the first mode (I), the inductance element 9 such as a resonance coil is additionally disposed, and for example, one end of the element is connected to the resonance capacitor 8; and the capacitor is connected to a junction of the switching elements 5H and 5L. The other end of the inductance element 9 is connected to the primary winding 7*p* of the AC conversion transformer 7. In this configuration, a combined series reactance of the inductance element 9 and the primary winding 7*p* is used.

In the second mode (II), a combined series reactance of the inductance element 9 and the leakage inductance can be used.

In both the modes, the series resonance of the resonance capacitor 8 and the inductive element, such as the inductance component and the inductance element, is used, the driving frequency of the switching elements 5H, 5L is defined to a value which is higher than the series resonance frequency, and the switching elements are alternately turned ON and OFF. As a result, a discharge lamp 10 connected to the secondary winding 7*s* of the AC conversion transformer 7 can be sinusoidally lighted. In the driving control of the switching elements by the controlling means 6, each switching element must be activated reciprocally so as not to be in the ON state simultaneously, by controlling the ON duty or the like. The series resonance frequency is denoted as "f", the electrostatic capacitance of the resonance capacitor 8 as "Cr", the inductance of the inductance element 9 as "Lr", and the primary inductance of the transformer 7 as "Lp1". Before the discharge lamp is lighted, "$(f=f1=1/(2\cdot\pi\cdot\sqrt{(Cr\cdot(Lr+Lp1))})$" is attained as in the mod (I), and, after the discharge lamp is lighted on, "$(f=f2\cong 1/(2\cdot\pi\cdot\sqrt{(Cr\cdot Lr)})$" is attained ($f1<f2$) as in the mod (II).

In the application of invention, the controlling means 6 can be configured in any manner. For example, the following configuration may be employed. A circuit of controlling the no-load output voltage before the discharge lamp is lighted on, or that of controlling a transient input power after the discharge lamp is lighted on or the input power in a steady state is disposed to define a control voltage, the voltage is subjected to V (voltage) –F (frequency) conversion to obtain a pulse signal, and a signal which is obtained by shaping the pulse signal is sent as a control signal to the switching elements 5H, 5L.

In order to stably control the discharge lamp, for the driving frequency of the switching elements 5H, 5L, the frequency after the discharge lamp is lighted on is preferably set higher than the frequency before the starting signal is generated. In a state before the discharge lamp is lighted on by applying the starting signal, the secondary circuit of the AC conversion transformer 7 is opened, and hence the transformer can be assumed equivalently as a choke coil. In this state, therefore, the series resonance frequency is equal to f1 as described above, and lower than f2 in the light on state. In the starting process, consequently, the switching elements are controlled by the driving frequency in the vicinity of f1. After the discharge lamp is lighted on, the switching elements are controlled by the driving frequency which is positioned in the vicinity of the series resonance frequency f2 that is defined by the electrostatic capacitance of the resonance capacitor 8, and the inductance of the inductance element 9, or the inductance and the leakage inductance of the AC conversion transformer 7.

In the power control, the switching control is preferably conducted at the driving frequency which is higher than the series resonance frequency. When the driving frequency is made coincident with the series resonance frequency, the maximum power can be output, thereby the power is supplied as an initial power to the discharge lamp, and lighting of the discharge lamp is promoted, so as to be rapidly transferred to the steady state. When the switching control is conducted at the driving frequency which is lower than the series resonance frequency, the combined impedance of the electrostatic capacitance of the resonance capacitor and the inductance enters in the capacitive region, and the power control is hardly conducted. Therefore, it is preferable to control the driving frequency, the switching frequency, so as to avoid such a situation as much as possible.

The starting circuit 4 is disposed in order to supply the starting signal to the discharge lamp 10. An output of the starting circuit 4 in the starting process is boosted by the AC conversion transformer 7 and then applied to the discharge lamp 10. In other words, the starting signal is superimposed on the AC-converted output and then supplied to the discharge lamp.

In this example, one of output terminals of the starting circuit 4 is connected to a middle of the primary winding 7*p* of the AC conversion transformer 7, and the other output terminal is connected to one end, which is a ground terminal, of the primary winding 7*p*. Alternatively, for example, both the output terminals of the starting circuit 4 may be connected to a middle of the primary winding 7*p* of the AC conversion transformer 7. In order to generate a pulse voltage having a peak value which is required for starting the discharge lamp 10 in the secondary side of the AC conversion transformer 7, a voltage which is as high as possible must be supplied to a capacitor in the starting circuit 4 to charge the capacitor. In this example, one of the input terminals of the starting circuit 4 is connected to a junction of the resonance capacitor 8 and the inductance element 9, and the other input terminal is connected to the ground line, so that the resonance voltage is used. Alternatively, other configurations may be employed in which the input voltage is obtained from the secondary side of the AC conversion transformer, and in which an auxiliary winding, a winding 11 which will be described later, which is provided to constitute a transformer with the inductance element 9, and the input voltage for the starting circuit is obtained from the auxiliary winding.

The starting circuit 4 may be configured in any form. For example, the circuit may comprise plural rectifying elements, capacitors, and switch elements. As the switch elements, self-breakdown elements such as spark gaps or varistors, or semiconductor elements having a control terminal such as thyristors, IGBTs (insulated gate bipolar transistors), or FETs may be used.

In a circuit configuration of this example, in which a DC-DC converter is not used and conversion from a DC input to an AC and a boosting operation are conducted only by the DC-AC converter circuit 3 to control the power of the discharge lamp, a path for detecting the current flowing through the discharge lamp as a DC cannot be formed, and hence, for example, a method may be employed in which a current detection resistor is connected to the discharge lamp in series. In this method, however, the dielectric strengths and the like of the resistor and a detection circuit must be set high according to a high voltage in a starting process of the discharge lamp. This impedes the miniaturization and reduction of the cost. In the circuit, therefore, the winding is added to the inductance element 9 for resonance, and another winding is added to the AC conversion transformer 7, thereby obtaining the voltage and the current detection values of the discharge lamp.

The auxiliary winding 11 forms a transformer with the inductance element 9 is disposed to detect a current corresponding to that flowing through the discharge lamp 10. An output of the auxiliary winding is sent to a current detection circuit 12. The current of the discharge lamp is detected using the inductance element 9 and the auxiliary winding 11, and a result of the detection is sent to the controlling means 6 and light on/off state determining means, which will be described later, to be used in the power control and the determination of light on/off state of the discharge lamp.

The voltage applied to the discharge lamp 10 is detected on the basis of an output of the primary winding 7*p* or the secondary winding 7*s* of the AC conversion transformer 7, or the detection winding 7*v* disposed in the transformer. In this example, the output of the detection winding 7*v* is sent to a voltage detection circuit 13, and the circuit obtains a detection voltage corresponding to the voltage applied to the discharge lamp 10. The detection voltage is sent to the controlling means 6 and the light on/off state determining means, which will be described later, to be used in the power control and the determination of light on/off state of the discharge lamp.

Figure 2:
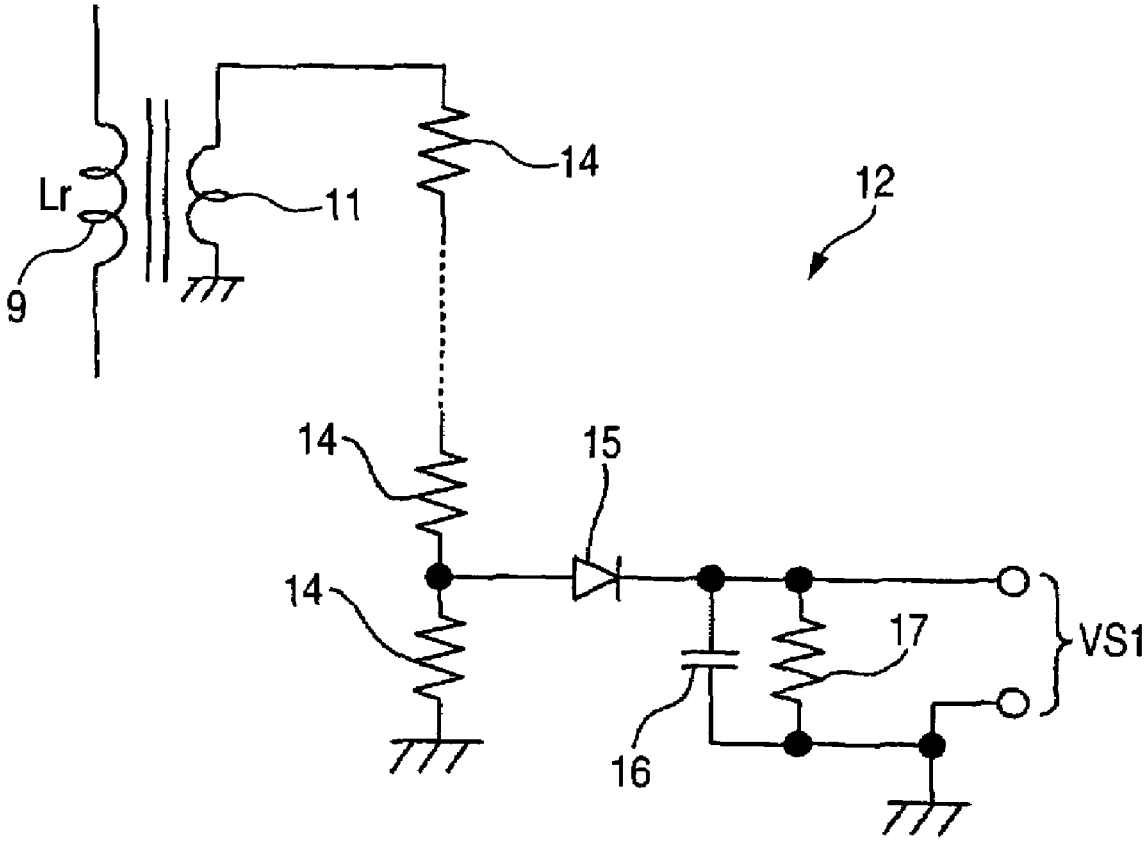
FIG. 2 is a circuit diagram showing an example of a current detection circuit for a discharge lamp.

FIG. 2 shows an example of the configuration of the current detection circuit 12.

Plural voltage-dividing resistors 14, 14, . . . are connected in series to one end (ungrounded terminal) of the auxiliary winding 11. One end of the voltage-dividing resistor 14, which is positioned in the lowest stage, is connected to a rectifying element 15, and the other end id grounded. In this example, a diode, such as a Schottky barrier diode, is used as the rectifying element 15. A voltage which is obtained by the voltage division is supplied to the anode of the diode, and the cathode of the diode is connected to one of detection output terminals.

One end of a capacitor 16 is connected to the cathode of the rectifying element (diode) 15, and the other end is grounded. A resistor 17 is connected in parallel to the capacitor 16.

As described above, a detection circuit having a basic configuration can be used as the current detection circuit 12, and an AC signal which is detected by the inductance element 9 and the auxiliary winding 11 is converted to a DC signal, referring to a detection voltage "VS1" in FIG. 2. Therefore, a signal is obtained which can be easily used in the light on/off state determining means and the controlling means in the subsequent stage.

The starting signal (pulse voltage) which is generated by the starting circuit 4 is voltage-divided by the plural resistor elements, so that the detection voltage corresponding to the peak voltage can be suppressed to an acceptable level. Therefore, the circuit for suppressing a high voltage which is generated in a starting process of the discharge lamp can be configured in a very simple manner. In a method in which the transformer formed by the inductance element 9 and the auxiliary winding 11 is set to have a small turn ratio, when the amplitude of the detection voltage in the light on state of the discharge lamp is excessively low, there are cases that a sufficient detection accuracy cannot be obtained.

An output current, which is the secondary current of the AC conversion transformer 7 and is denoted as "I2", is proportional to the primary current of transformer 7, denoted as "I1". The current I1 flows through the inductance element 9. When the value of the angular frequency "107" is known, which corresponds to the driving frequency of the switching elements, and "I1·(ω·Lr)" is detected, therefore, it is possible to obtain the lamp current indirectly.

Figure 3:
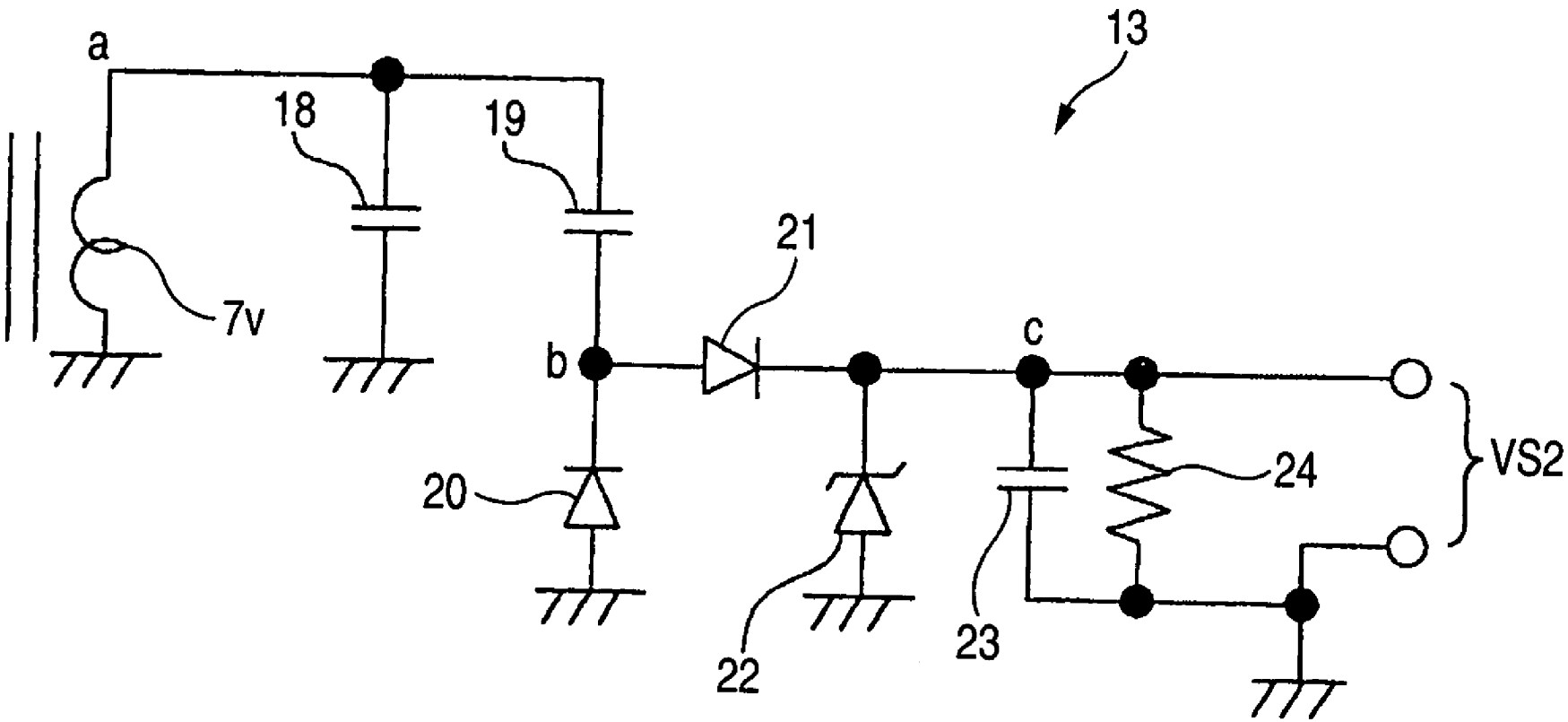
FIG. 3 is a circuit diagram showing an example of a voltage detection circuit for the discharge lamp.

FIG. 3 shows an example of the configuration of the voltage detection circuit 13. A detection circuit is used which includes rectifying elements and capacitors in the basic configuration.

The ungrounded terminal, referring to point a in FIG. 3, of the detection winding 7*v* is connected to one end of a capacitor 18, and the other end of the capacitor is grounded. A capacitor 19, which is provided in parallel to the capacitor 18, is connected to the cathode of a diode 20 and the anode of a diode 21. The anode of the diode 20 is grounded.

The cathode of the rectifying diode 21 is connected to one of detection output terminals, and also connected to the cathode of a Zener diode 22 and one end of a capacitor 23. The anode of the Zener diode 22 and the other end of the capacitor 23 are grounded.

A resistor 24 is connected in parallel to the capacitor 23 to obtain the detection voltage denoted as "VS2".

For the capacitors 18, 19, elements must be used which can withstand the pulse voltage in the starting process. However, the other elements are not required to have a high dielectric strength.

In this circuit, in a state when a high voltage pulse is applied in the starting process of the discharge lamp, a voltage is applied to the detection winding 7*v*, and the voltage can be detected by the capacitors 19 and 23 and the resistor 24. The impedances of the capacitors 19, 23 are set so that the impedance of the capacitor 23 is smaller by about one order of magnitude, and the resistance of the resistor 24 is sufficiently larger than the impedance of the capacitor 23. A voltage which is applied to point b in FIG. 3, which is the junction of the anode of the diode 21 and the capacitor 19, depends on the impedance ratio of the capacitors 19 and 23.

In a state when the discharge lamp is lighted on, the current flows only in one direction by the function of the diode 21, the capacitor 23 is charged, and charges are gradually accumulated therein, thereby the voltage across the capacitor is raised, referring to point c in FIG. 3. When the potential of one end of the detection winding 7*v* (the potential of the point a in FIG. 3) is substantially equal to the terminal potential of the capacitor 23 (the potential of the point c in FIG. 3), no current flows through the capacitor 19. Even when a voltage applied to the detection winding 7*v* is low, the detection voltage of the discharge lamp in the steady state is detected without being voltage divided by the capacitors 19 and 23. Therefore, required accuracy is ensured.

The capacitor 18 in the first stage is added in order to absorb the restriking-voltage. When the tube voltage is low immediately after the discharge lamp is lighted on, the restriking-voltage having a narrow-pulse like shape has a high peak crest. When the voltage detection circuit detects the voltage of the peak portion by an error, the correct voltage cannot be obtained. Consequently, the restriking-voltage of a high frequency is dulled by the capacitor 18, and the voltage is detected more correctly.

The Zener diode 22 has a function as a clamp element to suppress a high voltage due to the generation of a starting pulse voltage, and serves as a limiter for a surge voltage when such a pulse voltage is generated.

The detection signals obtained by the current detection circuit 12 and the voltage detection circuit 13 are sent to light on/off state determination means 25 as shown in FIG. 1. In FIG. 1, the means may be included in the controlling means 6, but both the means are separately shown.

The light on/off state detecting means 25 is disposed in order to detect whether the discharge lamp 10 is in light on state or in light off state, on the basis of the voltage and the current detection values of the discharge lamp. Light on state and light off state of the discharge lamp is detected, in that, with respect to the absolute value of the difference between the voltage detection value and the current detection value of the discharge lamp, the value in light off state of the discharge lamp is larger than that in light on state.

Figure 4:
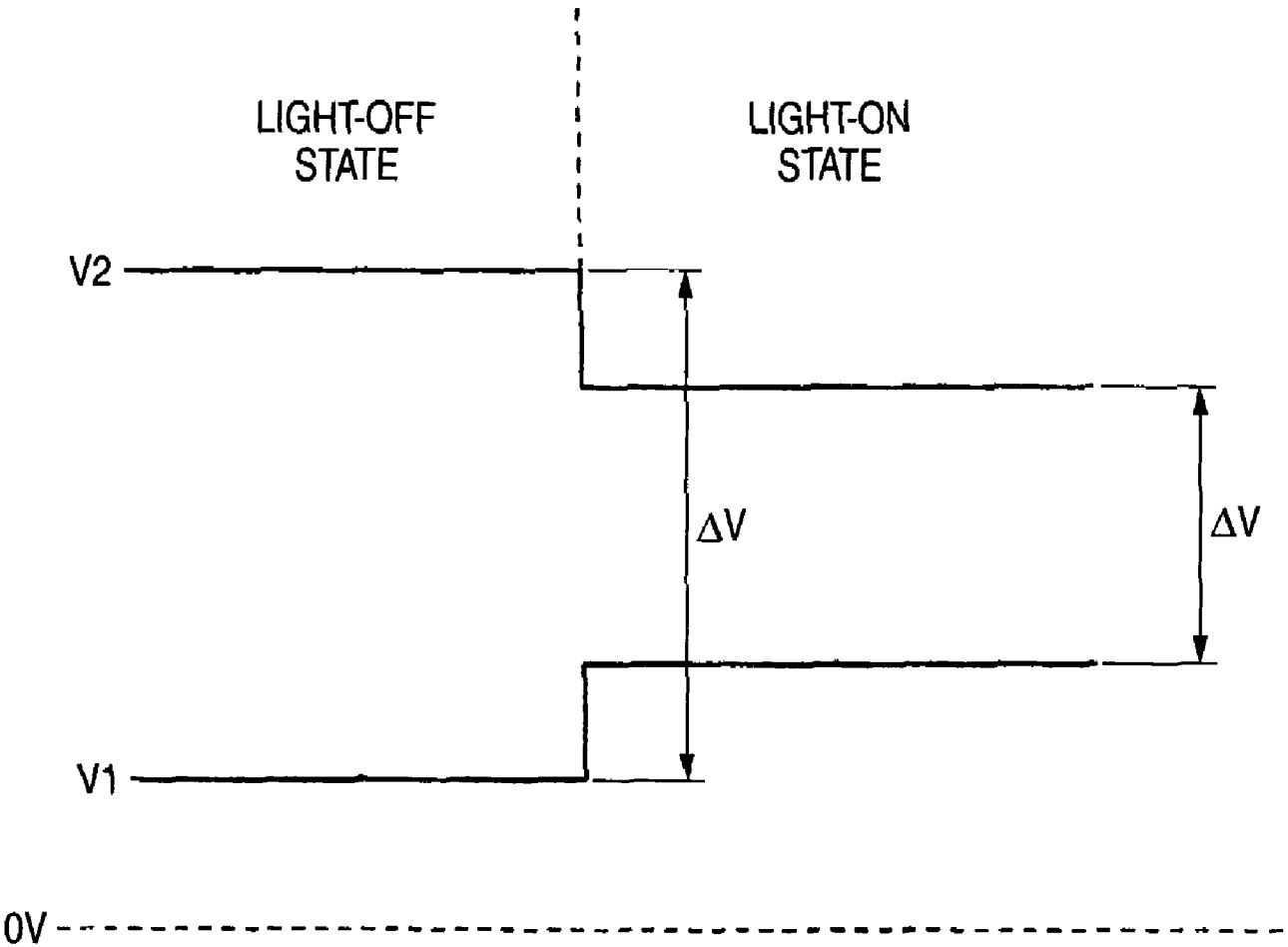
FIG. 4 is a diagram of light on/off determination.

FIG. 4 is a diagram illustrating light on/off state detection, and "V1", "V2", and "ΔV" represent the followings:

"V1"=voltage across the inductance element 9;

"V2"=voltage applied to the primary inductance Lp1 of the AC conversion transformer 7; and

"ΔV"=V2−V1.

In usual light on state of the discharge lamp, the state when the lighting operation is conducted at a driving frequency which is higher than the series resonance frequency f2 is shown in the right side of FIG. 4, and the state when the discharge lamp is in light off state due to any cause is shown in the left side. However, it is assumed that the switching frequency (the driving frequency) immediately after light off state is equal to that in light on state which is immediately before the light off state). The current detection voltage of the discharge lamp is proportional to V1, and the detection voltage for voltage detection of the discharge lamp is proportional to V2. In the following, therefore, description will be made mainly by using V1 and V2.

For V2, the value in light off state is higher, and that in light on state is lower. For V1, conversely, the value in light off state is lower, and that in light on state is larger. Therefore, the magnitude of ΔV in light off state is higher than that in light on state. As a result, the light on/off state can be detected by obtaining the difference between the voltage detection value corresponding to V2 and the current detection value corresponding to V1, and comparing the difference with a threshold or a reference range in which a margin safety is added to the threshold. For example, a detection value corresponding to ΔV is calculated from the voltage detection value and the current detection value. If the calculated value is equal to or larger than the threshold, the lamp state is detected as light off state, and, if the calculated value is smaller than the threshold, the lamp state is detected as light on state.

For ΔV, alternatively, a result which is obtained by calculating "V1−V2" and comparing the calculated value with a threshold may be used.

Figure 5:
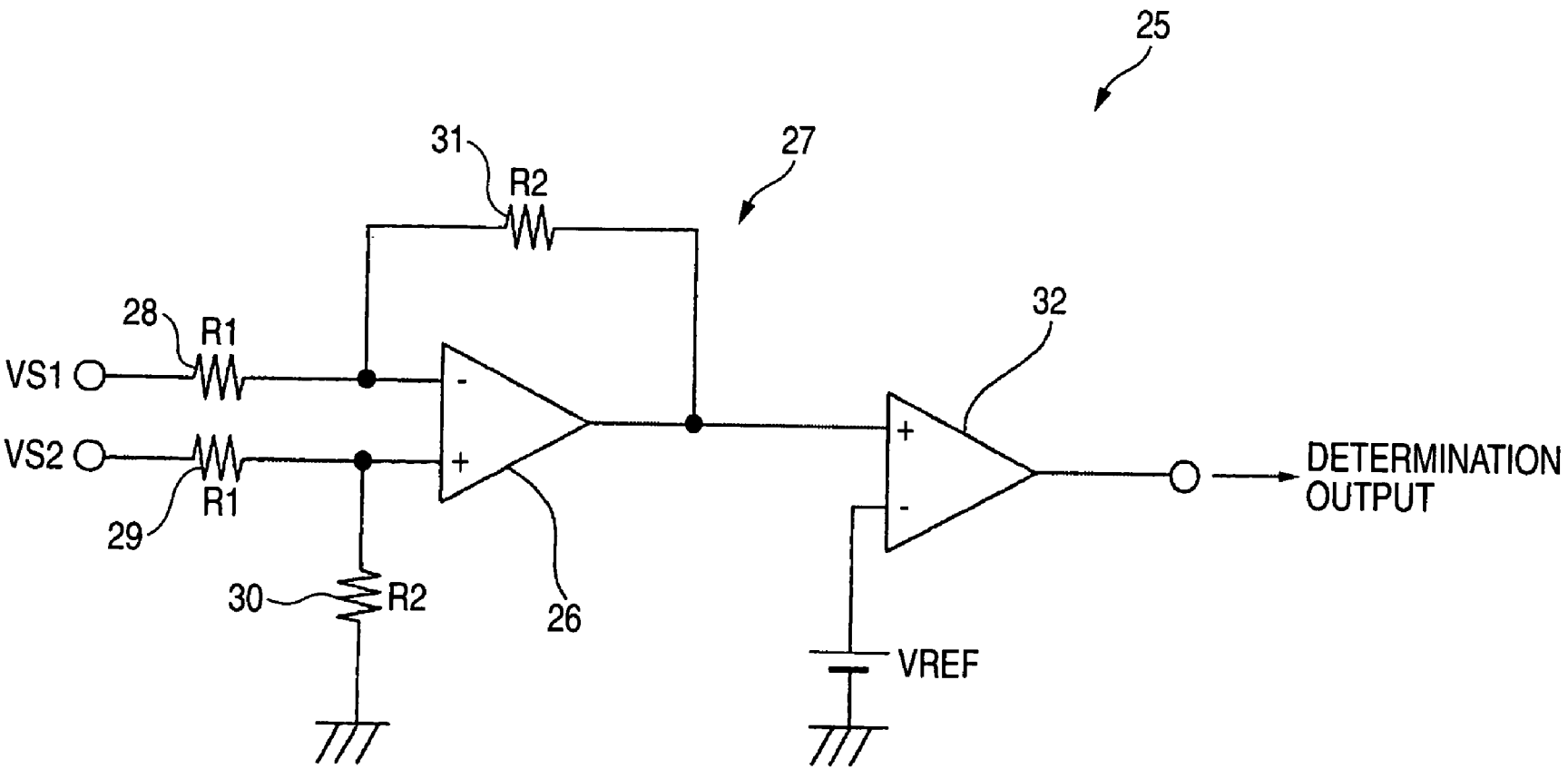
FIG. 5 is a diagram showing an example of the circuit configuration of light on/off determining means.

FIG. 5 shows an example of the circuit configuration of the light on/off state detecting means 25.

The detection voltage "VS1" obtained by the current detection circuit 12, and the detection voltage "VS2" obtained by the voltage detection circuit 13 are supplied to a subtracting circuit 27 in which an operational amplifier 26 is used. Specifically, "VS1" is supplied through a resistor 28 to an inverting input terminal of the operational amplifier 26, and "VS2" is supplied through resistors 29 and 30 to a non-inverting input terminal of the operational amplifier 26. One end of the resistor 30 is connected to the non-inverting input terminal of the operational amplifier 26, and the other end is grounded. A resistor 31 is interposed between the inverting input terminal and an output terminal of the operational amplifier 26. The resistances of the resistors 28 and 29, denoted as "R1", are equal to each other, and those of the resistors 30 and 31, denoted as "R2", are equal to each other.

The operational amplifier 26 sends an output ((R2/R1)·(VS2−VS1)) which is proportional to the difference between VS2 and VS1, to a positive input terminal of a comparator 32 which is placed in a subsequent stage. A predetermined reference voltage, denoted as "VREF", is supplied to a negative input terminal of the comparator 32. When the operation result proportional to "VS2−VS1" is compared with VREF, light on/off state of the discharge lamp is detected. Specifically, when the output level of the operational amplifier 26 is equal to or higher than VREF, the output signal of the comparator 32 is set to H (High) level. This means that the discharge lamp is in the light off state. When the output level of the operational amplifier 26 is lower than VREF, the output signal of the comparator 32 is set to L (Low) level. This means that the discharge lamp is in the light on state.

In this example, the lighting circuit comprises: the circuit which subtracts the current detection value from the voltage detection value of the discharge lamp; and the circuit which compares a result of the subtraction by the circuit with the threshold voltage, and the light on/off state of the discharge lamp is indicated as a binary data. These circuits may be configured by discrete circuit elements. Alternatively, in the case when the controlling means 6 is materialized by a control IC, a circuit for light on/off state determination may be configured in the IC.

Next, advantages of the case when the invention is applied will be described by way of a specific example.

Referring to FIG. 1, an example will be described in which the electric power of the discharge lamp in light on state is 35 W, when the DC input voltage VB is 42 V, Cr=6.8 nF (nanofarads), Lr=2.5 μH (microhenries), Lp1=2.5 82 H, and the turn ratio of the AC conversion transformer 7 is set to "n1 (the number of turns of the primary winding): n2 (the number of turns of the secondary winding)=4:25". In this example, the followings are attained.

Current detection (V1) light-on state: 12 V light-off state: 4 V

Voltage detection (V2) light-on state: 16 V light-off state: 21 V

When the voltage difference for V1 between light-on state and light-off state is denoted as "ΔV1", |ΔV1 |=|12−4|=8 V. When the voltage difference for V2 between light on state and light off state is denoted as "ΔV2", |ΔV2 |=|16−21|=5 V. In the latter case, the voltage difference is smaller, and hence the margin is small in light on/off state determination using the voltage difference. For V1, the voltage difference is relatively large, but there is a possibility that a sufficient margin could not be obtained when Cr, Lr, Lp, the turn ratio of the transformer, and the tube voltage of the discharge lamp are changed. For example, when the value of Lp1 is reduced, the value of V1 in light-off state is increased, and the value of V2 is lowered, and as the result, magnitudes of ΔV1 and ΔV2 are both reduced. When the DC input voltage is raised, there is an influence that the value of V1 in light-off state is increased.

In light on/off state determination of the discharge lamp based on the voltage difference for V1 or V2 between light on state and light-off state, when the absolute value of the voltage difference is small, consequently, error might occur in detection.

By contrast, when the invention is applied, light on/off state of the discharge lamp can be determined based on a relative difference between V1 and V2. When the difference between the two voltages is "ΔV=V2−V1", in the above example, |ΔV|=|16−12|=4 V is attained in light on state, and |ΔV|=|21−4|=17 V is attained in light off state. Therefore, the difference between light on state and light off state is |4−17|=13 V, and a sufficient detection margin is obtained. When the magnitudes of ΔV1 and ΔV2 are both decreased, a sufficient margin cannot be obtained in the conventional detection method. Even in such a case, according to the invention, the sum of the values serves as a margin, causing a function of reducing error in determination, which is secure. In the above example, considering that the value of V1 in light on state is larger than that of V1 in light off state, and assuming that V1=9 (=4+5) in light on state, both the magnitudes of ΔV1 and ΔV2 are 5 V. By contrast, for 66 V, |ΔV|=|16−9|=7 V is attained in light on state, and |ΔV|=|21−4|=17 V is attained in light off state, so that the difference between ΔV values is |7−17|=|(16−9)−(21−4)|=|(16−21)−(9−4)|=10 V is attained. That is, the detection margin is equal to the sum of the absolute values of ΔV1 and ΔV2. As a result, for example, even in the case when the value of Lp1 is decreased, the value of V1 in light off state is increased, that of V2 is decreased, and both the magnitudes of ΔV1 and ΔV2 are decreased, it is possible to ensure the sufficient detection margin.

As described above, when comparing the configuration in which, , the difference between voltage and current detection values of a discharge lamp is obtained, and light on/off state of the discharge lamp is detected from the result of comparing the difference with a threshold of a reference range, and the configuration in which one of voltage and current detection values is compared with a threshold or a reference range, it is obvious that the former configuration can detect light on/off state with a larger detection margin.

As described above, the present invention has various advantages. According to the invention, light on/off state determination can be conducted correctly on the basis of a result of the relative comparison between the voltage detection value and the current detection value, and the reliability of the lighting circuit can be enhanced. The difference between the voltage detection value and the current determination value is obtained, and the obtained difference is compared with a predetermined threshold or a reference range, thereby light on/off state determination can be easily conducted.

The employment of the configuration providing the circuit which subtracts the current detection value from the voltage detection value, and the circuit which compares the subtraction result with the threshold voltage, simplifies the lighting circuit, making the lighting circuit suitable for miniaturization.

In the mode in which one step of voltage conversion is conducted by the AC conversion transformer, even when a sufficient determination margin is hardly ensured by only one of the voltage detection value and the current detection value of the discharge lamp, the frequency of occurrence of an error in determination can be reduced.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A discharge lamp lighting circuit comprising:

a DC-AC converter circuit comprising:

an AC conversion transformer having primary and secondary sides;

a plurality of switching elements; and a series resonant circuit coupled to the primary side of the AC conversion transformer and including a resonance capacitor and an inductance element being serially connected to said resonance capacitor;

where said DC-AC converter circuit is operable to perform DC-AC conversion by controlling a driving frequency of said switching elements so as to supply a resonance voltage from said AC conversion transformer to a discharge lamp;

voltage detecting means for detecting a voltage applied to a discharge lamp;

current detecting means for detecting a current flowing through said discharge lamp where said current detection is performed by an auxiliary winding forming a transformer with said inductance element, and means for determining light on/off state of said discharge lamp based on values corresponding, respectively, to the voltage detected by said voltage detecting means and the current detected by said current detecting means, wherein said determination is performed with respect to such a condition that an absolute value of difference between the value corresponding to the voltage detected by the voltage detection means and the value corresponding to the current detected by the current detection means being detected during light-off state is larger than that of being detected during light-on state.

2. A discharge lamp lighting circuit according to claim 1, wherein said means for determining light on/off state obtains the difference between the voltage detection value and the current detection value of which result is compared with a threshold value or a reference range that is predetermined with respect to said condition.

3. A discharge lamp lighting circuit according to claim 2, wherein said means for determining light on/off state is comprised of a subtracting circuit which subtracts the current detection value from the voltage detection value; and a comparison circuit which compares a result of the subtraction with the threshold value.

* * * * *